US012043966B2

(12) United States Patent
Sandor, Jr.

(10) Patent No.: US 12,043,966 B2
(45) Date of Patent: Jul. 23, 2024

(54) PEDESTAL PAVER WITH TRANSPARENT OR TRANSLUCENT INSERTS

(71) Applicant: Light Penetrating Systems, LLC, Medina, OH (US)

(72) Inventor: Frederick J. Sandor, Jr., Medina, OH (US)

(73) Assignee: LIGHT PENETRATING SYSTEMS, LLC, Medina, OH (US)

( * ) Notice: Subject to any disclaimer, the term of this patent is extended or adjusted under 35 U.S.C. 154(b) by 0 days.

(21) Appl. No.: 18/506,506

(22) Filed: Nov. 10, 2023

(65) Prior Publication Data

US 2024/0167233 A1 May 23, 2024

Related U.S. Application Data

(60) Provisional application No. 63/427,586, filed on Nov. 23, 2022.

(51) Int. Cl.
*E01C 17/00* (2006.01)
*E01C 5/00* (2006.01)

(52) U.S. Cl.
CPC ..... *E01C 17/00* (2013.01); *E01C 5/001* (2013.01)

(58) Field of Classification Search
CPC ..... E01C 17/00; E01C 5/001
See application file for complete search history.

(56) References Cited

U.S. PATENT DOCUMENTS

| | | | | |
|---|---|---|---|---|
| 4,674,245 | A | 6/1987 | Turner | |
| 6,082,886 | A | 7/2000 | Stanford | |
| 6,116,751 | A | 9/2000 | Remp | |
| 8,021,014 | B2 | 9/2011 | Jacobsen | |
| 8,905,571 | B2 | 12/2014 | Sigler | |
| 9,114,422 | B1 | 8/2015 | Toma et al. | |
| 9,598,867 | B1 | 3/2017 | Conklin | |
| 10,422,139 | B1 | 9/2019 | Warmerdam | |
| 10,481,315 | B2 | 11/2019 | Daniels | |
| 10,519,612 | B1 | 12/2019 | Toma et al. | |
| 11,299,423 | B1 | 4/2022 | Ketty et al. | |
| 2006/0291196 | A1 | 12/2006 | Benavente | |
| 2014/0328052 | A1 | 11/2014 | Hochman et al. | |
| 2018/0327979 | A1* | 11/2018 | Szekely | E01C 3/006 |
| 2022/0341163 | A1* | 10/2022 | Parsons | E01C 5/20 |

* cited by examiner

*Primary Examiner* — Abdulmajeed Aziz
*Assistant Examiner* — Jessica M Apenteng
(74) *Attorney, Agent, or Firm* — Sand, Sebolt & Wernow Co., LPA

(57) ABSTRACT

A pedestal paver has a plurality of apertures. There are a plurality of waveguide inserts wherein there is one waveguide insert in one apertures. The waveguide inserts are formed from a transparent or translucent material to permit light generated from a light source disposed vertically below the pedestal paver to shine upwardly through the waveguide insert. The waveguide inserts have a configuration that is complementary to the portion of the body of the pedestal paver that defines the aperture. The pedestal paver is supported by the pedestal at a corner of the paver.

18 Claims, 8 Drawing Sheets

PEDESTAL PAVER WITH TRANSPARENT OR TRANSLUCENT INSERTS

REFERENCE TO RELATED APPLICATIONS

This application claims the benefit of U.S. Provisional Application Ser. No. 63/427,586, filed on Nov. 23, 2022; the disclosure of which is incorporated herein by reference.

TECHNICAL FIELD

This disclosure is directed generally to illuminated pavers for walkways or flooring.

BACKGROUND ART

There are many examples of conventional paving stones or paving blocks, which are commonly referred to as "pavers." These conventional pavers are used to make driveways, walkways and patios. A typical paver is a solid block of natural stone, or a cast stone-like material such as concrete or so-called "cultured stone". However, pavers can be made from other materials, such as engineered hardwood or natural wood. Mostly, these pavers engage the ground.

Recently, these ground-engaging pavers have been provided that include cavities that are used to house light sources, such as filament bulbs, electroluminescent or light emitting diodes (LEDs). Some exemplary ground-engaging (i.e., non-elevated) illuminated pavers are shown in U.S. Pat. No. 10,481,315 and US Patent Application Pre-Grant Publication Nos. 2014/0328052 and 2006/0291196.

Some non-illuminated pavers that are elevated and do not directly engage the ground are known as pedestal pavers inasmuch as they are elevated from the ground and are supported by pedestals. The pedestals are installed on a support surface or base material/layer. Then, the pedestal pavers are placed atop the pedestals and supported from below by the pedestal. The support from the pedestal elevates the paver from the ground surface which assists with, amongst other things, proper leveling of the paver and drainage or water below/through the pavers.

SUMMARY OF THE INVENTION

What is needed is an improved elevated pedestal paver that has the ability to shine or illuminate light upwardly through the pedestal-type paver.

In one aspect, an exemplary embodiment of the present disclosure may provide a pedestal paver comprising: a body having a first end and a second end defining a first direction therebetween, a first side and a second side defining a second direction therebetween, and a top surface and a bottom surface defining a third direction therebetween; a plurality of apertures extending fully through the body from the top surface to the bottom surface, wherein at least one aperture is countersunk from the top surface thereby defining a surface that delineates an upper portion of the at least one aperture and a lower portion of the at least one aperture, wherein the upper portion of the at least one aperture has a greater diameter than the lower portion of the at least one aperture; a waveguide insert that is formed from a translucent or transparent material disposed within the at least one aperture, wherein the waveguide insert is adapted to permit the transmission of light in the third direction through the waveguide insert; and a corner of the body that is adapted to be supported from the bottom surface by a pedestal to elevate the pedestal paver above a base layer or support structure. One exemplary embodiment or another exemplary embodiment may provide that the countersunk configuration of the at least one aperture is a flat countersink. One exemplary embodiment or another exemplary embodiment may provide that the countersunk configuration of the at least one aperture is a tapered countersink. One exemplary embodiment or another exemplary embodiment may provide that the countersunk configuration of the at least one aperture is a conical countersink. One exemplary embodiment or another exemplary embodiment may provide that the countersunk configuration of the at least one aperture is a beveled countersink. One exemplary embodiment or another exemplary embodiment may provide that the countersunk configuration of the at least one aperture is a curved countersink. One exemplary embodiment or another exemplary embodiment may provide that the countersunk configuration of the at least one aperture is a rounded countersink.

One exemplary embodiment or another exemplary embodiment may provide that the waveguide insert is T-shaped in cross section and complementary to a cross-sectional configuration of a portion of the body that defines the at least one aperture.

One exemplary embodiment or another exemplary embodiment may provide that the surface is a ledge that is a flat annular surface that circumscribes a central axis of the at least one aperture.

This exemplary embodiment or another exemplary embodiment may further provide a first row of apertures from the plurality of apertures, wherein the first row is aligned in the first direction; a second row of apertures from the plurality of apertures, wherein the second row is aligned in the first direction; wherein an amount of apertures in the first row is greater than an amount of apertures in the second row. One exemplary embodiment or another exemplary embodiment may provide that the amount of apertures in the first row is greater than the amount of apertures in the second row by one. One exemplary embodiment or another exemplary embodiment may provide that the first row of apertures is defined by five apertures and the second row of apertures is defined by four apertures.

This exemplary embodiment or another exemplary embodiment may further provide a first row of apertures from the plurality of apertures, wherein the first row is aligned in the first direction; a second row of apertures from the plurality of apertures, wherein the second row is aligned in the first direction; wherein the central axis of the at least one aperture that is in the first row is offset, relative to the second direction, from a second central axis of a second aperture in the second row. One exemplary embodiment or another exemplary embodiment may provide that the at least one aperture in the first row is offset, relative to the second direction, from the central axis of the second aperture in the second row by a distance that is at least equal to a radius of the at least one aperture in the first row and at most equal to twice the diameter of the at least one aperture in the first row.

This exemplary embodiment or another exemplary embodiment may further provide a radial surface of the waveguide insert, wherein the radial surface is reflective to direct light upwardly through the waveguide insert in the third direction.

One exemplary embodiment or another exemplary embodiment may provide that the plurality of apertures are arranged in a grid pattern. One exemplary embodiment or another exemplary embodiment may provide that the plurality of apertures are arranged in a circular pattern.

In yet another aspect, another embodiment of the present disclosure may provide a pedestal paver comprising: a body having a first end and a second end defining a first direction therebetween, a first side and a second side defining a second direction therebetween, and a top surface and a bottom surface defining a third direction therebetween; four corners of the body, wherein the four corners are supported at the bottom surface by four pedestals, respectively, wherein the four pedestals elevate the pedestal paver above a base layer or support structure to define a space between the bottom surface of the body and the base layer or support structure, wherein the space below the body is sized to accommodate a light source that transmits light; a central portion of the body that is equidistant from the four corners, wherein the central portion of the body is suspended above the base layer or support structure, and the central portion is not in physical contact with any pedestal or other structure that otherwise supports the body; a plurality of apertures extending fully through the body from the top surface to the bottom surface; and a waveguide insert that is formed from a translucent or transparent material disposed within the at least one aperture, wherein the waveguide insert is adapted to permit light transmission from the light source in the third direction through the waveguide insert.

In yet another aspect, another embodiment of the present disclosure may provide a pedestal paver method of installation comprising: aligning a corner of a body of pedestal paver with a pedestal, the body of the pedestal paver having a first end and a second end defining a first direction therebetween, a first side and a second side defining a second direction therebetween, and a top surface and a bottom surface defining a third direction therebetween; connecting the corner at the bottom surface of the body of the pedestal paver with the pedestal, wherein the pedestal is supported from below by a base layer or support structure; elevating the pedestal paver above the base layer or support structure thereby creating a space between the bottom surface of the pedestal paver and the base layer or support structure; disposing a light source in the space below the bottom surface of the pedestal paver; and activating the light source, wherein light from the light source propagates upwardly in the third direction through a waveguide insert that is formed from a translucent or transparent material disposed within an aperture defined within and extending fully through the body of the pedestal paver. This exemplary embodiment or another exemplary embodiment may further provide suspending a central portion of the body of the pedestal paver above the base layer or support structure, wherein the central portion is centrally offset from the corner, and the central portion is not in physical contact with any pedestal or other structure that otherwise supports the pedestal paver.

BRIEF DESCRIPTION OF THE DRAWINGS

Sample embodiments of the present disclosure are set forth in the following description, are shown in the drawings and are particularly and distinctly pointed out and set forth in the appended claims.

Similar numbers refer to similar parts throughout the drawings.

DETAILED DESCRIPTION

Figure 1:
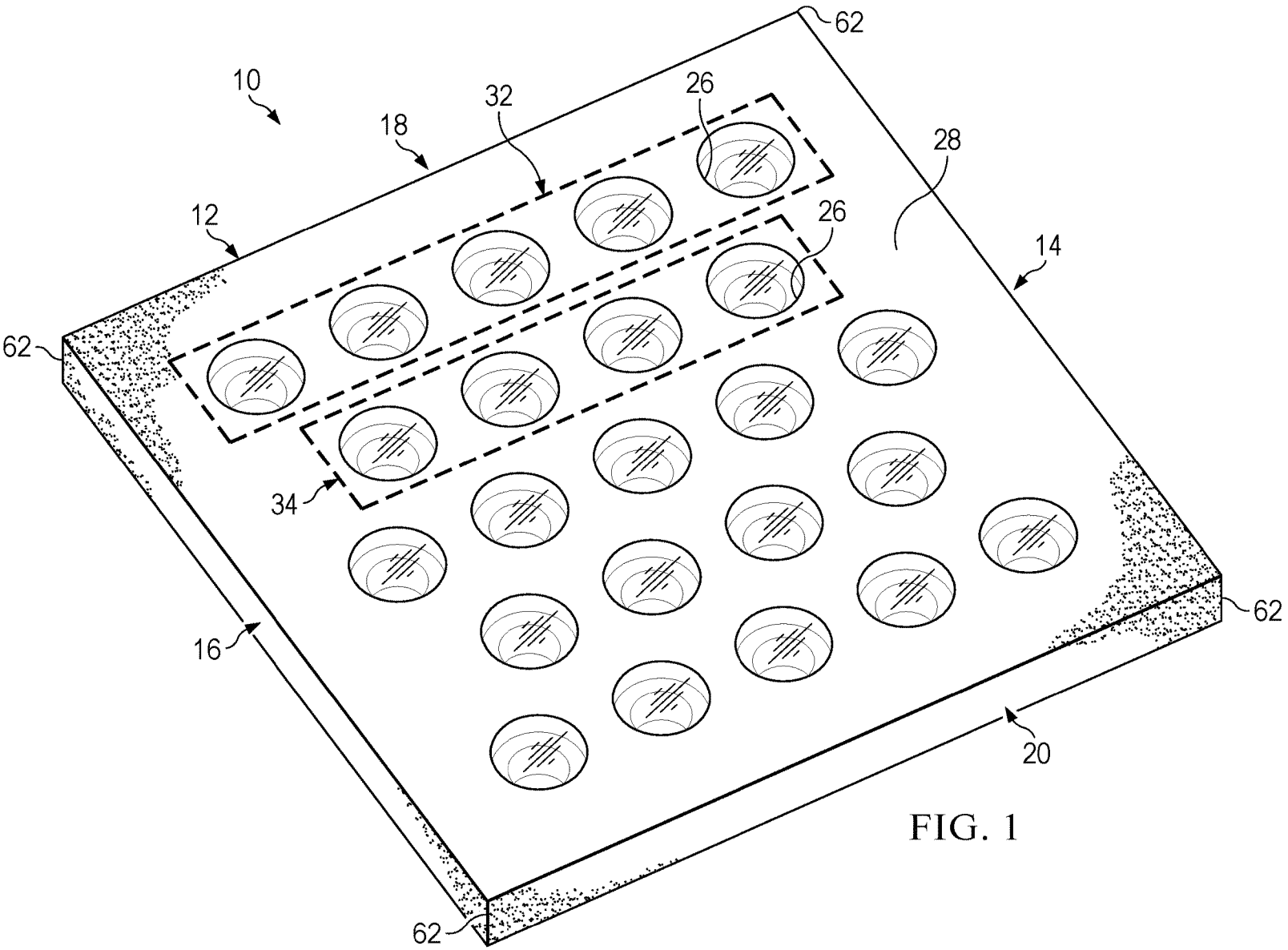
FIG. 1 is a top perspective view of a pedestal paver with transparent or translucent inserts according to one exemplary embodiment of the present disclosure.
Figure 2:
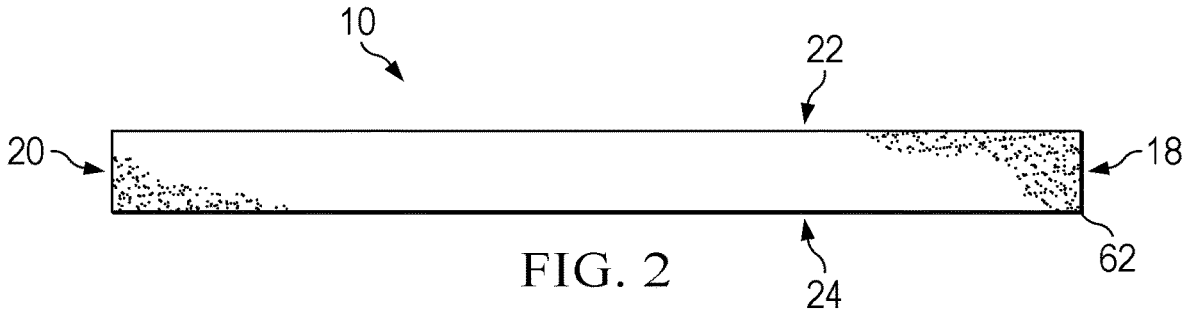
FIG. 2 is a first end elevation view of the paver.
Figure 3:
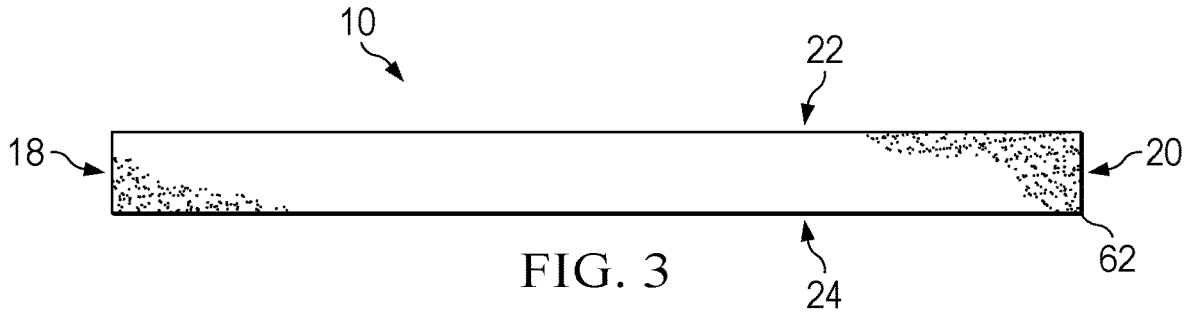
FIG. 3 is a second end elevation view of the paver.
Figure 4:
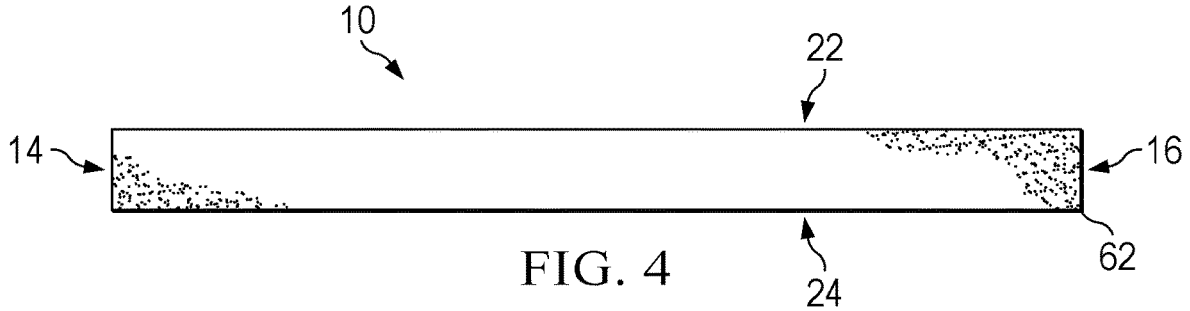
FIG. 4 is a first side elevation view of the paver.
Figure 5:
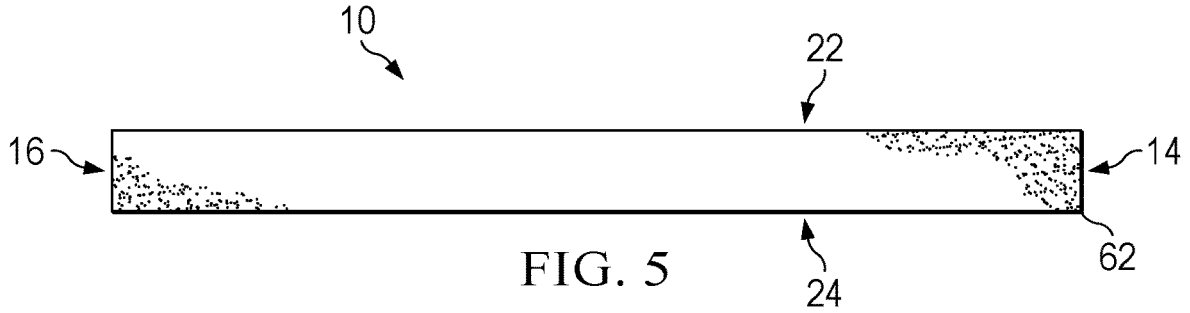
FIG. 5 is a second side elevation view of the paver.

A pedestal paver having transparent or translucent waveguide inserts is show generally throughout the figures and referred to generally as paver 10. However, it paver 10 should be understood to mean a pedestal paver that is elevated above a subsurface or base layer by pedestal supports at its corners so as to suspend a central portion above the subsurface or base layer without any other structure contacting that central portion of the paver at the bottom surface thereof.

Paver 10 includes a body 12 having a first end 14 opposite a second end 16 defining a first direction therebetween, a first side 18 opposite a second side 20 defining a second direction therebetween that is perpendicular to the first direction, and a top 22 opposite a bottom 24 defining a third direction therebetween that is orthogonal to the first direction and the second direction.

The body defines a plurality of apertures that extend fully through the body 12 in the third direction from the top surface 28 to the bottom surface 30. Top surface 28 and bottom surface 30 are major surfaces of body 12. The sidewalls of body 12 are minor surfaces defined by the thickness of the body 12 measured in the third direction from the top surface 28 to the bottom surface 30.

In one particular embodiment, the dimension of the body 12 of the paver 10 is 24 inches×24 inches×2 inch. In this instance, the length dimension is 24 inches measured in the first direction between the first end 14 and the second end 16, the width dimension is 24 inches measure in the second direction between the first side 18 and the second side 20, and the height or thickness dimension is 2 inch measured from the top surface 28 to the bottom surface 30. Although this example is a paver that is square, when viewed from above, other shapes of the paver are entirely possible. For example, the paver could be triangular, rectangular, pentagonal, hexagonal, octagonal, decagonal, or any other shape. Further, the dimensions detailed herein are exemplary and the body 12 of paver 10 can be any larger or smaller size depending on the application specific need or structural requirements needed for the installation of paver 10.

The plurality of apertures 26 define rows that are aligned in the first direction. In one exemplary embodiment, the plurality of rows alternate the number of apertures 26 within a given row relative to an adjacent proximate row. For example, as shown in one exemplary embodiment, there is a first row 32 of apertures 26 that is adjacent to a second row 34 of apertures 26, wherein the first row 32 of apertures 26 is composed of five apertures 26 and the second row 34 of apertures 26 is composed of four apertures 26. Stated otherwise, this pattern from the apertures is made by alternating long and short rows 32, 34 of apertures, where the long rows (i.e., first row 32) contain one more aperture than the short rows (i.e., second row 34). In this pattern the first and last row are both long rows (i.e., the "long pattern").

The apertures in one row, such as first row 32 are offset from the apertures 26 defining the second row 34 by a distance that is greater than the radius of one aperture 26 but less than two diameters of the aperture 26. This provides a staggered effect of the apertures when viewed from above.

The number of rows of apertures may vary depending on the application specific needs of paver 10. Thus, while the embodiment of paver 10 shown herein depicts five rows of alternating numbers of apertures 26, this is not meant to be limiting. For example, the number of rows, along with the number of apertures within each row, can vary based on the overall dimensions of paver 10. Thus, if paver 10 were 36 inches long×36 inches wide then there may be seven, or eight, or nine, or ten, or eleven, or twelve, or more rows of apertures that are staggered or alternate relative to each other. For example, if there were eleven rows of apertures, there may be ten apertures 26 in the first row of the eleven and there may be nine apertures 26 in the second row of eleven rows. As such, it is to be understood that the number of rows, along with the number of apertures within each row, can scale up or down to accommodate the overall dimensions of paver 10.

Although this arrangement of apertures 26 is exemplary and shown in the figures, other configurations of the apertures is entirely possible depending on the desired aesthetics of the paver 10 and the application specific installation requirements of paver 10. For example, the following provides other exemplary configurations and patterns that can be provided for apertures 26. A different pattern for the arrangement of apertures 26 or formed patterned could be a "short pattern" which is similar to the long pattern described above except that the first and the last row are both short (i.e., with one fewer aperture). A different pattern for the arrangement of apertures 26 or formed patterned could be an "alternate pattern" which is similar to the long pattern described above except that the first row 32 is long (i.e., with one more aperture) and the last row is short (i.e., with one fewer aperture), or vice versa. A different pattern for the arrangement of apertures 26 or formed patterned could be an "Wyoming pattern" where the first and the last row are long, while all other rows are short. A different pattern for the arrangement of apertures 26 or formed patterned could be an "Oregon pattern" where all rows in this pattern are of the same length with the exception of the middle row, which is two apertures fewer. This Oregon pattern requires an odd number of rows.

Figure 9:
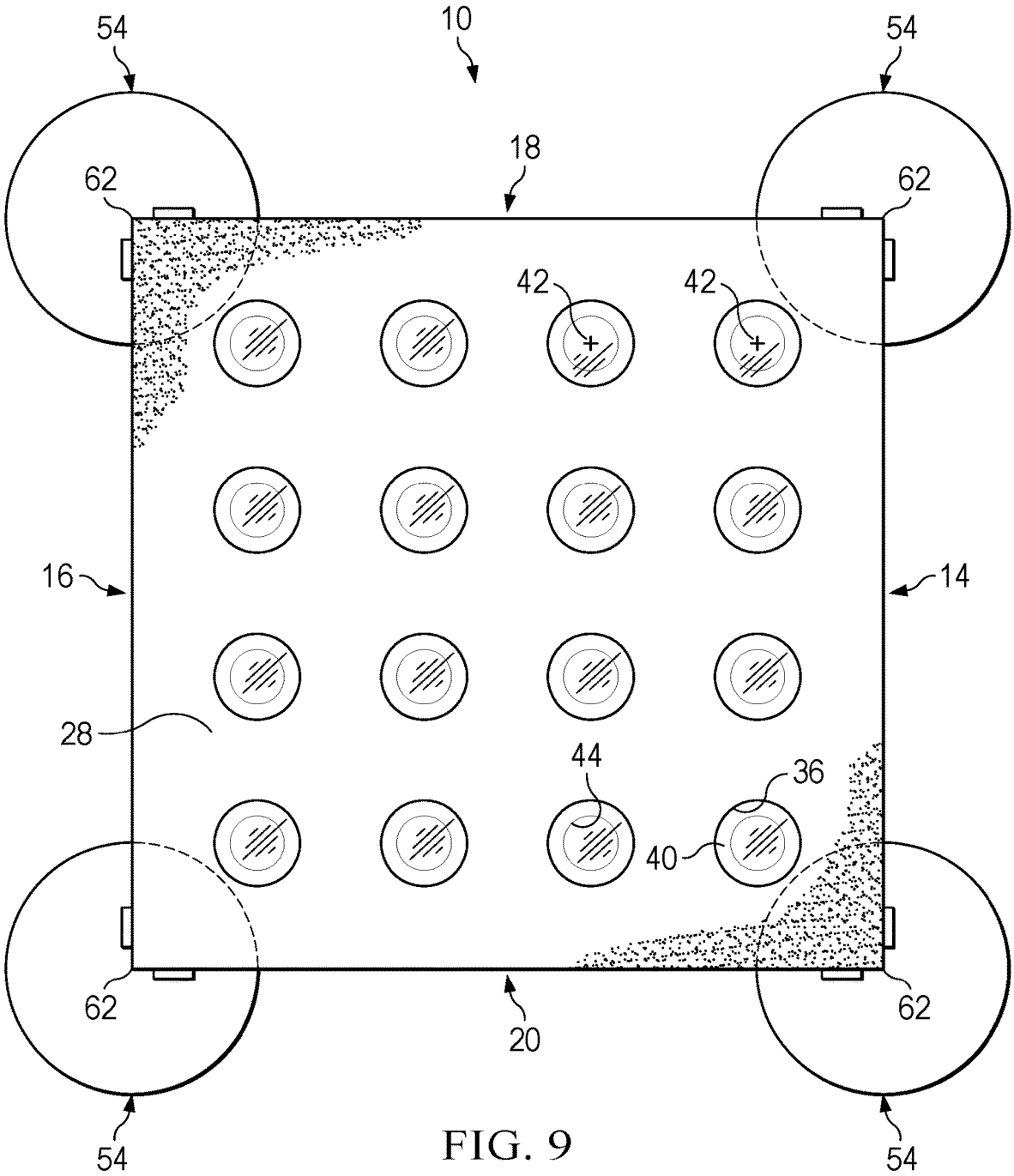
FIG. 9 is an environmental top plan view depicting another exemplary paver that is supported by pedestals at each respective corner of the paver, wherein this exemplary waveguide configuration is an equal pattern.

FIG. 9 depicts another exemplary pattern for the arrangement of apertures 26 or formed patterned could be an "equal pattern" where all rows have the same number of apertures, wherein an equal pattern can provide four rows and within each of the four rows contains four apertures.

Still further, another embodiment could provide a grid or array formation of apertures 26, which may be different than the equal pattern if the number of rows does not equal the number of apertures in each respective row, for example five rows of four apertures each or four rows of five apertures each. Apertures arranged in a regular grid or array formation provide a structured and organized appearance. This pattern allows for even light distribution and can create a modern, geometric aesthetic. Another embodiment could provide a linear or strip formation for apertures 26. Apertures arranged in linear or strip patterns offer a sleek and elongated design. This configuration can be used to guide the eye along a specific direction, providing a sense of movement and flow. Another embodiment could provide a circular or radial formation for apertures 26. Apertures arranged in circular or radial patterns create a focal point and draw attention to the center. This pattern can add a dynamic and eye-catching element, resembling ripples or concentric circles. Another embodiment could provide a random or organic formation of apertures 26. Apertures arranged in a random or organic pattern provide a more natural and artistic appearance. This configuration can mimic elements found in nature and provide a unique, non-uniform aesthetic. Another embodiment could provide a diamond or rhombus formation for apertures 26. Apertures arranged in a diamond or rhombus pattern offer a classic and elegant look. This pattern can add sophistication and visual interest to the design. Another embodiment could provide an interlocking or puzzle formation for apertures 26. Apertures arranged in an interlocking or puzzle-like pattern create a sense of unity and cohesion. This configuration can represent interconnectedness and add a playful, engaging element. Another embodiment could provide a hexagonal formation for apertures 26. Apertures arranged in a hexagonal pattern provide a trendy and modern aesthetic. This pattern can offer a unique visual appeal and enhance the overall design with a geometric touch. Another embodiment could provide a wave or waveform formation for apertures 26. Apertures arranged in a wavy or waveform pattern add a dynamic and fluid appearance. This configuration can create a sense of movement and rhythm, adding visual interest.

Figure 6A:
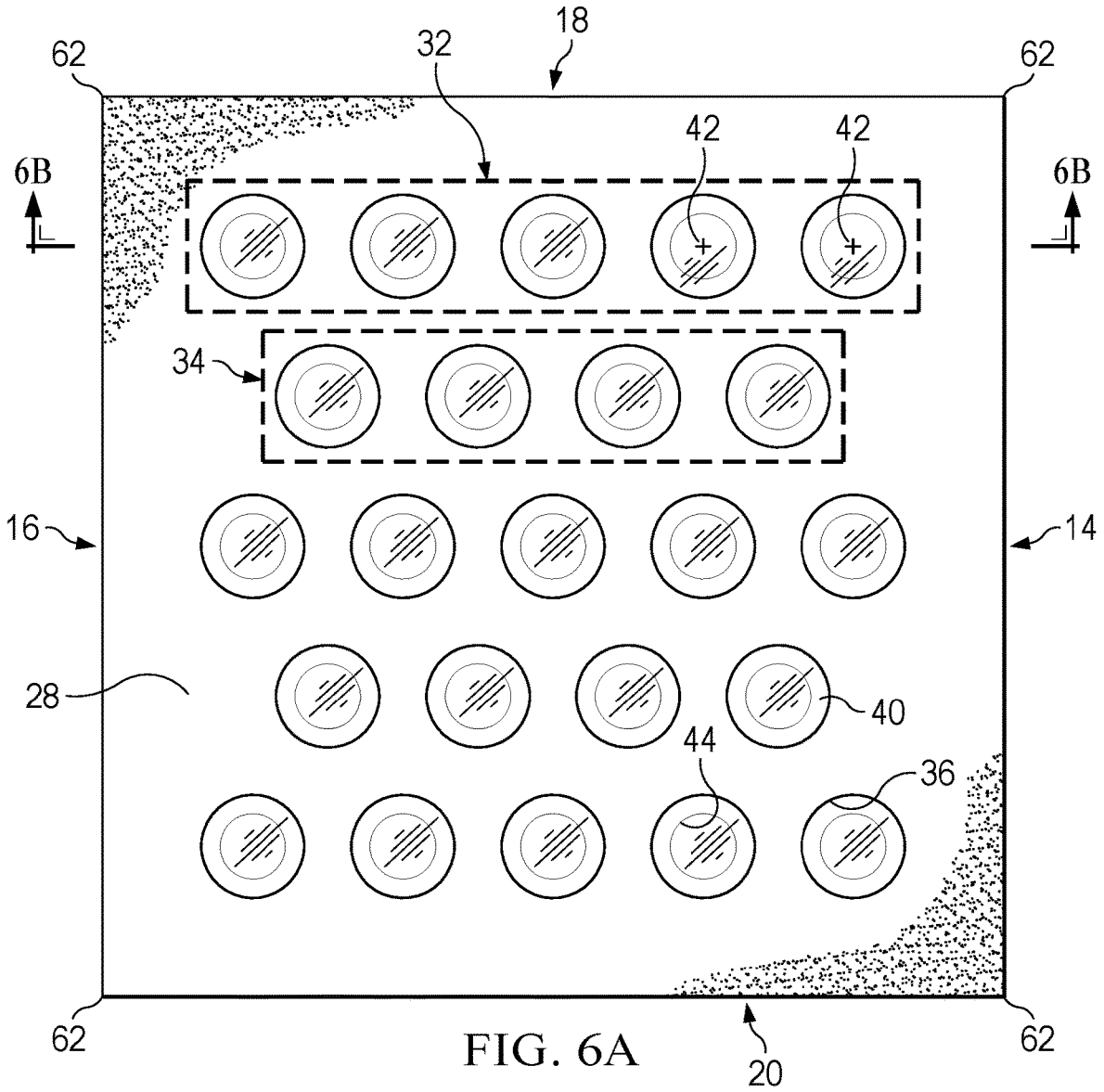
FIG. 6A is a top plan view of the paver.
Figure 6B:
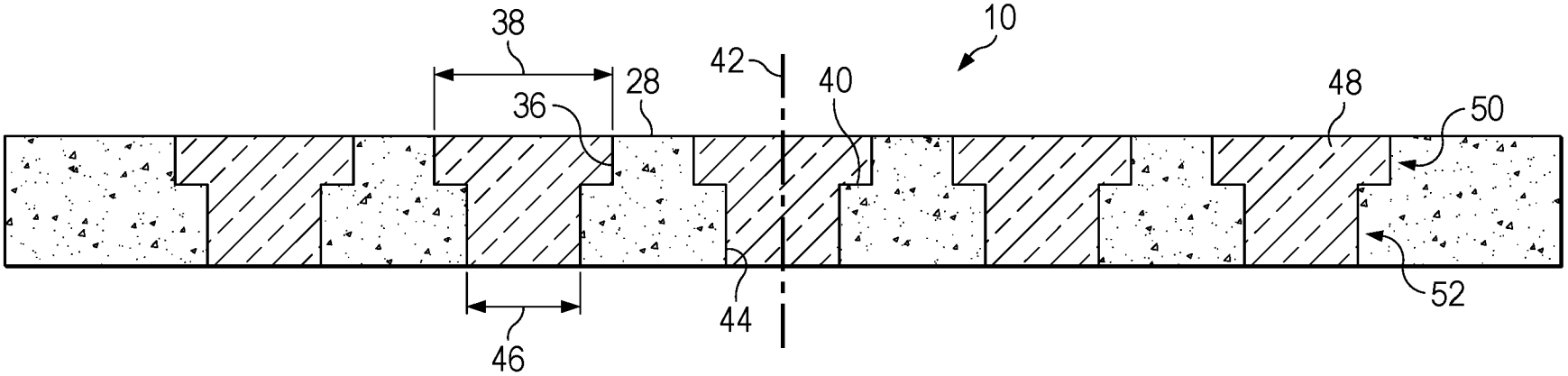
FIG. 6B is an elevation cross-section view taken along line 6B-6B in FIG. 6A.
Figure 7:
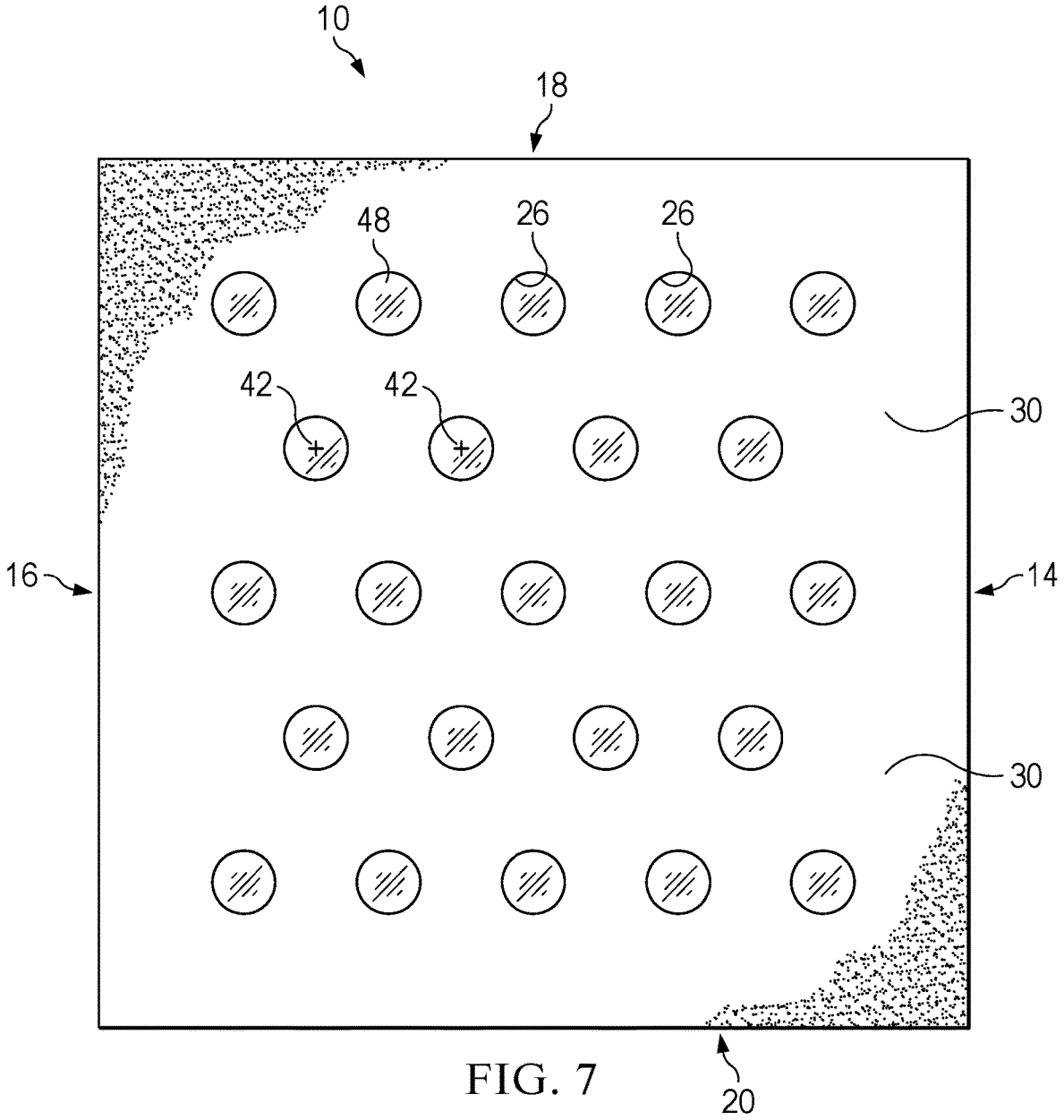
FIG. 7 is a bottom plan view of the paver.

In one embodiment, each aperture 26 is countersunk from the top surface 28 such that the diameter of aperture 26 is greater at the top surface 28 than the diameter of the aperture 26 at the bottom surface 30. With respect to the flat countersink configuration, a flat countersink involves creating a flat-bottomed recess or indentation in the top surface 28 of body 12, forming a level platform or ledge to support the insert 48. In this embodiment, the ledge defines a surface that delineates an upper portion of the aperture and a lower portion of the at least one aperture 26. The top of the insert 48 fits into this flat-bottomed recess, ensuring a stable and flush placement. In this particular embodiment, when viewed in cross-section (see FIG. 6B), the aperture 26 is defined by a cylindrical sidewall 36 having a first diameter 38. First diameter 38 may range from about 1 inch to about 4 inches. In one embodiment the first diameter 38 is 2.75 inches. The cylindrical sidewall 36 extends downwardly in the third direction from the top surface 28 towards the bottom surface 30. Cylindrical sidewall 36 terminates at a ledge 40 that is horizontal and parallel to the first direction and second direction. The ledge 40 is a flat annular ledge that circumscribes a central or center axis 42 extending through the aperture 26 parallel to the third direction through which the diameter is measured and from which the radius is measured. The ledge 40 extends inwardly from sidewall 36 towards the center axis 42, but the inner end of ledge 40 terminates short of or before the axis 42. The aperture 26 is continued to be defined by a second cylindrical sidewall 44 that has a second diameter 46. Second diameter 46 is smaller or less than first diameter 38. Second diameter 46 may range from about 0.5 inch to about 3.5 inches. In one embodiment the second diameter 46 is 2.25 inches. In the exemplary embodiment, the cross-section configuration of the aperture 26 is generally T-shaped. The dimension of the ledge, which may be a radial width of the ledge, is equal to the first diameter 38 less the second diameter 46. Thus, when the first diameter 38 is 2.75 inches and the second diameter 26 is 2.25 inches, then the radial width of the ledge 40 equal to 0.5 inch.

With respect to first diameter 38 and second diameter 46, it is understood that these are dimensions that would be measured relative to the center axis, which extends in the third direction. Thus, the measurement of the dimension of the first diameter 38 and the second diameter 46 would be measured parallel to one of the first direction and the second direction. However, it is to be noted that the term dimension is not limited to a diameter only, which implies a circular shape. Rather, as described further herein, the aperture can have different shapes or different countersink configuration. Thus, the dimension of the upper portion of the aperture and the dimension of the aperture could represent dimensions of other shaped apertures, yet still the upper portion of the aperture has a dimension greater than that of the lower portion of the aperture.

Instead of the apertures 26 having a circular perimeter, when viewed from above, the perimeter of the of the apertures 26 can be a different shape. For example, the perimeter of the apertures could be square or triangular or any of the other listed shapes detailed herein. In these instances, the aperture may still be countersunk regardless of its perimeter configuration.

With respect to the countersink configuration, another embodiment can be provided with a tapered countersink, a tapered countersink involves creating a recess with sloped or angled sides, gradually deepening toward the center to form a cone-like shape. In this embodiment, the sloped or angled sides defines the surface that delineates an upper portion of the aperture and a lower portion of the at least one aperture 26. The insert 48 would be shaped complementary to the tapered countersink and is inserted into this tapered recess, and the sloped walls of the countersink provide stability and prevent the insert from slipping out. Alternatively, a conical countersink may be provided. A conical countersink is similar to a tapered countersink but features a more pronounced cone shape with a steep slope. The insert 48 is seated within this conical recess, and the slope of the countersink securely holds the insert in place. Still further, a beveled countersink could be utilized and involves creating a recess with beveled edges, forming a V-shaped groove. In this embodiment, V-shaped groove defines the surface that delineates an upper portion of the aperture and a lower portion of the at least one aperture 26. The top part of the insert 48 fits into this V-shaped groove, providing a snug fit and preventing lateral movement.

With continued reference to the countersink configuration, another embodiment can be provided with a cupped countersink. A cupped countersink involves creating a recess that is concave or bowl-shaped. The insert 48 is placed within this concave recess, with the edges of the recess providing support for the insert. In this embodiment, the concave edges define the surface that delineates an upper portion of the aperture and a lower portion of the at least one aperture 26. The insert 48 would be shaped complementary to the cupped countersink and is inserted into this curved recess, and the curved walls of the countersink provide stability and prevent the insert from slipping out. Alternatively, a rounded countersink could be utilized that has a rounded or semi-circular indentation in the paver's surface. The top of the insert 48 is seated within this rounded recess, allowing for a secure fit. In this embodiment, the indentation defines the surface that delineates an upper portion of the aperture and a lower portion of the at least one aperture 26.

The choice of countersink configuration of aperture 26 will depend on factors such as design aesthetics, the shape of the inserts, ease of insertion, and the desired level of security for holding the inserts in place. Each configuration offers unique advantages and may be selected based on the specific requirements of the paver 10. However, each embodiment of a countersink ultimately has a surface that delineates an upper portion of the aperture and a lower portion of the at least one aperture.

Further, each countersink configuration may have distinct functionalities related to retaining the insert 48 and influencing the transmission of light through the insert. For example, with respect to a flat countersink configuration of aperture 26, the flat countersink provides a stable and flush platform for a T-shaped insert 48, offering horizontal support to prevent lateral movement of the insert. Since the insert sits flush, light transmission can be relatively consistent and unaffected, resulting in uniform illumination. With respect to a tapered countersink configuration of aperture 26, the sloped sides of the tapered countersink guide the insert into a snug fit, offering both lateral and vertical support to retain the insert securely. The taper can slightly disperse light, causing a softening effect or diffusing the light, resulting in a more uniform distribution. With respect to a conical countersink configuration of aperture 26, the steep slope of the conical countersink firmly holds the insert, providing both lateral and vertical support, making it difficult for the insert to dislodge. The conical shape can direct and focus light, potentially enhancing the brightness or creating a spotlight effect. With respect to a cupped countersink configuration of aperture 26, the concave recess of the cupped countersink offers lateral support, cradling the insert securely to prevent movement. The concave shape may help direct light upward, enhancing brightness and possibly creating a spotlight-like effect. With respect to a rounded countersink configuration of aperture 26, the rounded countersink allows the insert to rest securely with support around the edges, minimizing lateral movement. The rounded shape may disperse light slightly, creating a soft glow or spreading light more evenly. With respect to a beveled countersink configuration of aperture 26, the V-shaped groove of the beveled countersink provides support for the insert from the sides, ensuring a snug fit. The beveled shape can direct light, potentially focusing or diffusing it, depending on the angle and depth of the V-shaped groove.

Each aperture 26 is filled or contains a waveguide insert 48. For brevity, each waveguide insert may simply be referred to as insert 48. Each insert 48 is shaped complementary to the portion of the body 12 that define each aperture 26. As such, the perimeter shape, when viewed from above and/or below, of the insert complements that of the aperture 26. When the aperture 26 has a circular perimeter, so too does the insert 48. If the aperture 26 has a perimeter shape that is different than a circle, then the insert 48 would have that same complementary shape. Further, in the shown exemplary embodiment having a flat countersink, the insert 48 is generally T-shaped in cross-sectional configuration that is complementary to the aperture 26. However, when a different countersink configuration is utilized, the insert 48 would be shaped complementary to that respective countersink configuration of aperture 26. Each insert 48 may be formed from a material that is either transparent or translucent to permit light to be shined from below the paver 10 upwardly in the third direction through the insert. For example, the insert 48 may be formed from glass or a man-made polymer material. The material forming insert 48 may be colorless or tinted with a color for an aesthetic appearance when light is not being shined through the insert 48 from below. While not shown herein, it is envisioned that a light emitting diode or other light source would be installed below the bottom 24 of the paver 10 to emit light to be shined upwardly in the third direction through each insert 48 that is disposed within an aperture 26 of body 12. The position of the light source (e.g., LED lights) beneath the paver at a strategic location. This could be within a cavity or space either below or in the body 12 to ensure the light is evenly distributed.

Providing translucent inserts 48 or light waveguides in pedestal pavers 20 to allow light to shine upwardly through them. The translucent or transparent material of insert 48 allows light to pass through. Some exemplary materials of insert 48 include acrylic, glass, or specialized plastics designed for optical clarity. Some exemplary materials that can be used to form inserts 48 included but are not limited to Acrylic (PMMA—Polymethyl Methacrylate), either cast acrylic that is known for excellent optical clarity, UV resistance, and scratch resistance or extruded acrylic that is less expensive than cast acrylic, but it may have slight variations in clarity. Additionally, glass, such as float glass or low iron glass (Extra Clear Glass) that is clear glass with a reduced iron content, providing exceptional clarity and color neutrality. Alternatively, polycarbonate that is known for high impact resistance, making it suitable for applications where durability is crucial; Polyethylene Terephthalate Glycol-Modified (PETG) that combines optical clarity with good impact resistance; or Polyvinyl Chloride (PVC), which although not as optically clear as acrylic or glass, PVC can be made into a transparent or translucent.

The manner in which inserts 48 connect to the body 12 can be accomplished in a variety of ways. For example, inserts may simply be placed within the apertures 26 such that the upper portion 50 of insert 48 is supported by and rests freely upon the ledge 40 and a lower depending portion 52 extends downwardly from the upper portion 50 between or within the second cylindrical sidewall 46. Because the insert 48 is complementary to the configuration or shape of the aperture 26, it is envisioned that the diameter of the insert 48 at the top surface 28 of body 12 will match or largely be equal to first diameter 38, and the diameter of the insert 48 at the lower depending portion 52 at or near the bottom surface 30 of body 12 will match or be similar to the second diameter 46. In other embodiments the inserts may be chemically connected to the body 12, such as through the use of an adhesive. In other embodiments, the inserts 48 may be mechanically connected to the body 12. In yet other embodiments, the insert 48 may be non-chemically and non-mechanically connected to body 12.

The edges where one insert 48 fit within one aperture 26 may sealed or adhered to maintain a secure fit and prevent moisture or debris from entering the hollow spaces or apertures 26. The choice of sealing materials depends on the specific materials of the paver and inserts, as well as the environmental conditions the installation will be exposed to. However, some exemplary sealing materials include silicone sealant which is widely used for sealing various surfaces due to its excellent flexibility, adhesion, and water resistance. It forms a durable, flexible seal that can withstand movement and temperature changes, making it suitable for outdoor applications. Silicone sealants come in various colors to match the aesthetics of the installation. Alternatively, polyurethane sealant provides strong adhesion, flexibility, and resistance to weather, chemicals, and UV exposure. This may be a good choice for sealing joints in outdoor applications where there may be movement or exposure to harsh weather conditions. Alternatively, epoxy resin is a strong adhesive that provides a solid bond and is resistant to moisture and chemicals. It can be used to fill gaps and seal edges effectively, ensuring a watertight seal. Epoxy can be clear or tinted to match the aesthetics of the installation. Alternatively, construction adhesive is a versatile bonding material that provides strong adhesion for various materials. It is commonly used to secure inserts and create a tight seal along edges and joints. Alternatively, acrylic sealant is easy to apply, dries quickly, and offers good adhesion and flexibility. It can be painted to match the surrounding surfaces and is commonly used for indoor and outdoor applications. Alternatively, butyl rubber sealant is known for its excellent waterproofing properties and flexibility. It is often used in situations where a waterproof and airtight seal is necessary.

Insert 48 has a top upwardly facing surface that is flat and coplanar with the upper surface 28 of body 12. While the top surface of insert 48 is shown as flat, it is also envisioned that the top surface of insert 48 could be concave or convex in order to focus or disperse light, respectively, should an application specific need or aesthetic design desire such a curvature. Similarly, the bottom surface of the insert 48 that is defined by the lower depending portion is coplanar with the bottom surface 30 of body 12. While the bottom surface is shown as flat, it could also be concave or convex to focus light from a light source positioned below the paver 10 to assist with the transmission of light through the transparent or translucent material defining insert 48. Further, other embodiments may provide that the bottom surface of the insert 48 may not be coplanar with the bottom surface 30 of body 12. In these configurations, the bottom surface of the of insert 48 could be inset from (i.e., above—within the aperture 26) the bottom surface 30 of body 12 or outset from (i.e., below) the bottom surface 30 of body 12.

Insert 48 is a light waveguide. As a waveguide, the insert 48 has a light receiving end and a light transmissive end. The receiving end of insert end is defined by the lower depending portion and the transmissive end is defined by the upper portion. In an alternative embodiment, insert 48 may be opaque if it is desired to have good contrast (light/dark) between the pixels on the light source. Alternatively, if the insert 48 allows for light transmission, interesting light and shadow effects can be produced where the light emitted from an LED leaks to and is carried to the surface of a neighboring insert. In accordance with one particular embodiment, the translucent or transparent material diffuses the light from the ends of the insert 48 to create a glowing light structure at the top of the body 12. The translucent material can include light diffusing particulate, UV inhibitors, etc., and the radial surface of the insert 48 can be reflective so that light that travels up the insert 48 to encourage light extraction out of the top of the insert 48 within the translucent material to better diffuse the light and make a more uniform color mix and glow.

While inserts 48 are shown generally as T-shaped in cross section for a flat countersunk aperture, it is entirely possible for the inserts to have other configurations. For example, if the aperture 26 is flat countersunk in both the top surface 28 and the bottom surface 30 of body 12, then the aperture and the waveguide insert would both be I-shaped in cross sectional configuration such that the diameter of the aperture would be greater at the top and bottom of the aperture than a lesser diameter in the vertically middle portion of the aperture.

Body 12 may be formed from any structurally supportive and generally rigid material that is utilized with pavers or pedestal pavers. For example, one embodiment envisions that the body 12 will be substantially composed of, comprised of, consist essentially of, or consist of concrete. However other embodiments could form the body with a material that is substantially composed of, comprised of, consist essentially of, or consist of wood or engineered hardwood. Other man-made polymers are entirely possible as well. In some embodiments, body 12 may formed or made from a mixture of cement, aggregate (such as sand or crushed stone), water, and sometimes additives like pigments or admixtures. The concrete mixture may be poured into molds to create individual pavers. Paver 10 may be provided in a variety of shapes, sizes, and designs. Common shapes defining the perimeter of paver 10 include square, rectangular, hexagonal, and interlocking. The design and pattern can be customized to achieve a specific aesthetic for the patio or walkway. Additionally, paver 10 may offer a wide range of design options, colors, and textures, allowing for creativity in the design of patios and walkways.

Further, another alternative embodiment may be provided in which the apertures 26 do not extend fully through the body 12. In this configuration, rather than being a full aperture, a cavity or depression can be formed in the top surface 28 of body 12 that extends downwardly in the third direction. The bottom surface of the cavity may be fully bound by the body 12. Then, a light source can be placed at the bottom of the cavity and a waveguide insert can be placed into the cavity on top of the light source. This will allow the light to be emitted by the light source, such as an LED, at the bottom of the cavity upwardly through the waveguide insert. The aesthetic configuration or arrangement of the cavities formed in body 12 can be provided in any of the manners described herein with respect to apertures 26.

When integrating waveguide inserts 48 into pedestal paver 10, the arrangement of inserts 48 should not compromise the strength or structural integrity of the paver 10. In some embodiments, the design and placement of waveguide inserts 48 can be strategically utilized to enhance the structural stability and strength of the paver 10. For example, the waveguide inserts 48 could be placed in areas of the body 12 of paver 10 that have less impact on its structural integrity. The inserts 48 could be distributed evenly across the surface to maintain a balanced load distribution and prevent any localized stress concentrations. Additionally, inserts 48 could incorporated materials that can reinforce the structural integrity of the paver 10, such as reinforcing fibers or a composite material with high strength properties. Further, the waveguide inserts 48 can be bonded to the paver material using strong adhesives or during the casting process to create a unified and strong structure. Additionally, the waveguide inserts can be integrated in a way that helps distribute any applied loads evenly across the paver's surface. Further, the inserts 48 can have shapes or structures that can help disperse stresses and prevent concentration of loads in specific areas. Further, in the areas of body 12 around the inserts 28 or around the apertures 26, there may be a reinforcement or mesh used in the paver's construction. This reinforcement can add to the structural strength and durability of the paver 10.

Figure 8A:
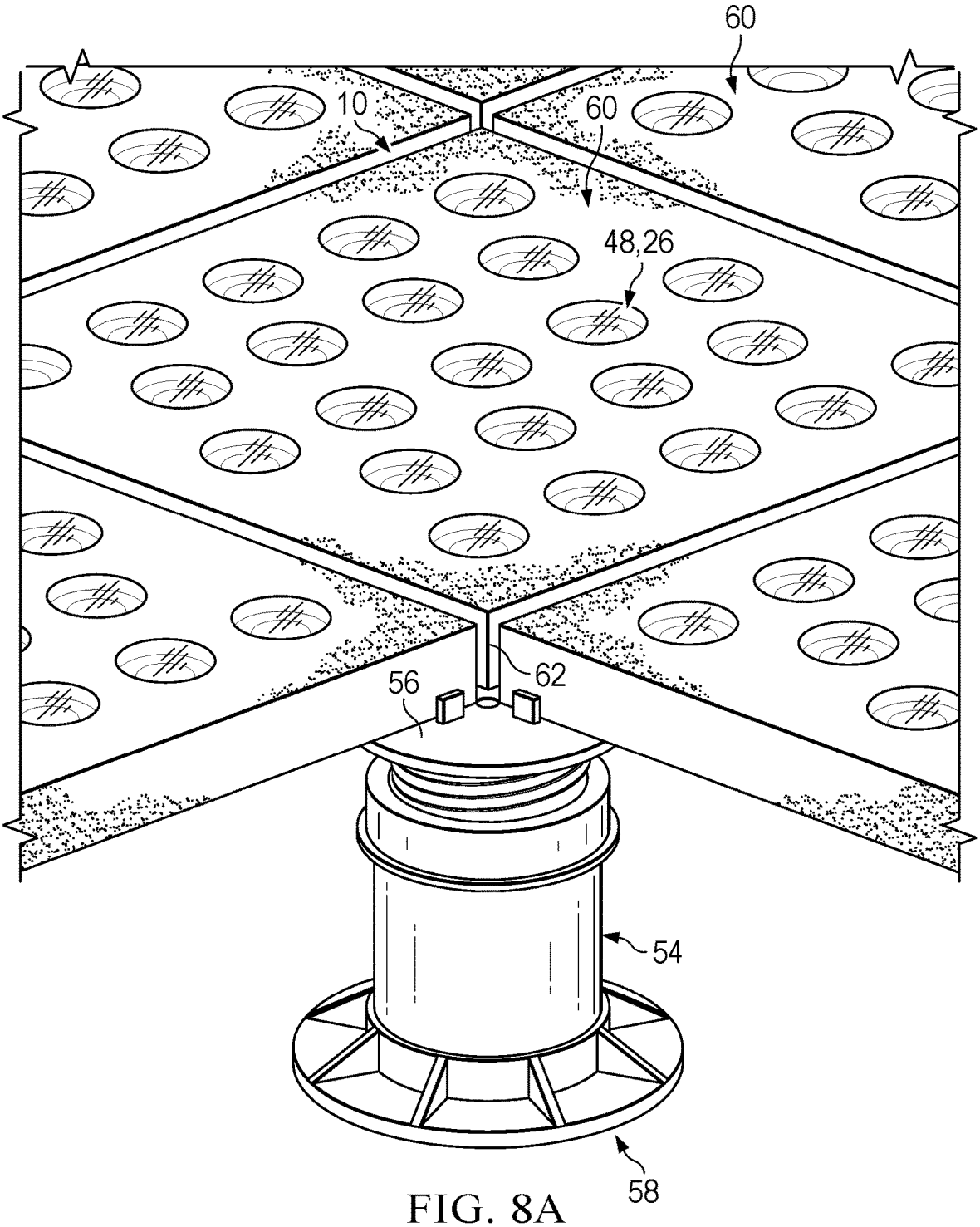
FIG. 8A is a top perspective view of a plurality of pavers that collectively define an array supported by at least one pedestal.
Figure 8B:
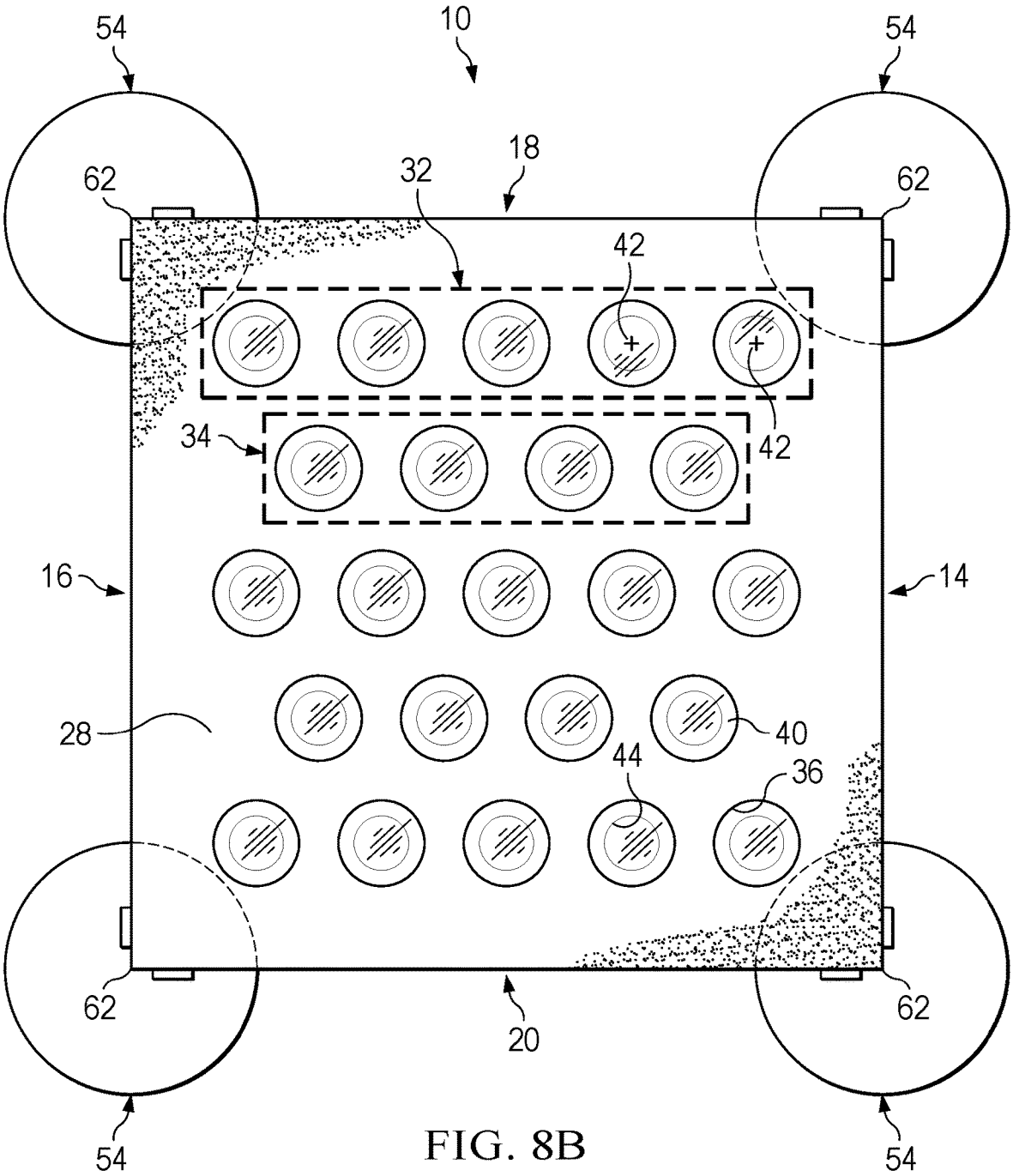
FIG. 8B is an environmental top plan view depicting one paver that is supported by pedestals at each respective corner of the paver.

FIG. 8A and FIG. 8B indicate that paver 10 is a type of pedestal paver used in conjunction with one or more pedestals 54 that support the paver 10 at one corner 62 thereof. One exemplary pedestal 54 is commercially available for sale by Tile Tech, Inc as part of its Tile Tech Pedestal System. FIG. 8B indicates that four pedestals 54 may be utilized to support each of the four corners 62 of paver 10 from below. As such, the upper surface 56 of pedestal 54 is configured and sized to engage and support the bottom surface 30 of the body 12 of paver 10 at the corner 62 thereof.

Configuring the corner 62 of the body 12 of the paver 10 to be supported by the pedestal 54 allows for elevation above a base layer or support structure (such as ground or other base surface). This elevated design offers benefits like proper drainage, easy access to utilities, and the creation of a level surface. A suitable pedestal 54 support system designed for elevating pavers should be chosen. These systems may include of adjustable pedestals that can be easily adjusted to achieve the desired height and levelness. The pedestals 54 may be at each corner 62 of the paver 10, ensuring they are securely anchored to (yet still above) the base layer or support structure. These pedestals will support the corners of the paver. The height of each corner pedestal may be adjusted to ensure the paver is level and aligned correctly. This leveling process helps in achieving a flat and even surface for the paver 10. The paver may be carefully placed on top of the aligned corner pedestals, ensuring that each corner of paver 10 is adequately supported. The paver should rest securely on the pedestals 54. Depending on the pedestal system, the paver 10 may be secured to the pedestals using appropriate clips or fasteners to ensure it remains in place and maintains the desired elevation. The elevated design created by the pedestals allows for space underneath the paver, enabling easy access to utilities or the light source that is placed below the paver 10 and configured to shine upwardly through inserts 48. By utilizing a pedestal support system, the corner 62 of the paver is securely elevated above the base layer or support structure. This elevation not only provides a level surface but also facilitates proper water drainage and allows for the concealment of the light source or other utilities beneath the paver, ensuring a clean and organized installation. Additionally, the adjustability of the pedestals ensures flexibility in achieving the desired elevation and alignment for the paver.

In one embodiment, the upper surface 56 of pedestal 54 is offset and spaced above a lower surface 58 of pedestal 54 to define a vertical offset distance that is oriented the third direction that spaces the pavers 10 above a base surface such as ground or a substructure. The vertical dimension of pedestal 54 that spaces the paver 10 above the base surface or the substructure allows a powered light source, such as a LED, to be installed in that space below to lower surface 30 or paver 10. The light source may be coupled to a switch or a computer controlled lighting logic to illuminate one or more lights from below the paver 10. Because the inserts 48 are transparent or translucent, the light from the light source that is installed below the bottom surface 30 or paver 10 permits the light to transmit upwardly in the third direction through the aperture and through the insert 48 to illuminate a collective walking surface 60 that is established when a plurality of pavers 10 are installed together to form a collective array of pavers 10, as shown in FIG. 8A. The illuminated walking surface defined by the array of pavers 10 is aesthetically pleasing and also assist with illuminating the path of travel for an operator that traverses across the walking surface, especially at nighttime.

The method of installation of paver 10 may be accomplished by aligning a corner of the body 12 of pedestal paver 10 with pedestal 54. Then, connecting the corner 62 at the bottom surface 30 of the body 12 of the pedestal paver 10 with the pedestal 54, wherein the pedestal is supported from below by a base layer or support structure. Then, elevating the pedestal paver 10 above the base layer or support structure thereby creating a space between the bottom surface 30 of the pedestal paver 10 and the base layer or support structure. Then, disposing a light source in the space below the bottom surface 30 of the pedestal paver. This step of disposing the light source below the bottom surface may occur before or after the corner of the paver 10 is connected to the pedestal 54. Then, activating the light source, wherein light from the light source propagates upwardly in the third direction through insert 48 that is formed from a translucent or transparent material disposed within aperture 26 defined within and extending fully through the body of the pedestal paver 10. Additionally, because the paver 10 is only supported by the pedestal 54 at the corner of the body 12, the method of installation may include suspending a central portion of the body 12 of the pedestal paver 10 above the base layer or support structure, wherein the central portion is centrally offset from the corner 62, and the central portion is not in physical contact with any pedestal or other structure that otherwise supports the pedestal paver 10.

If the light source is computer controlled, connecting computer-controlled lighting, such as LED lights, to a processor involves a combination of hardware and software components. The process typically involves interfacing the LED lights with a microcontroller or a dedicated LED controller and programming the microcontroller to execute specific instructions to produce desired lighting sequences. A user or installer may choose the appropriate type of LEDs (e.g., RGB LEDs) based on the desired lighting effects. RGB LEDs are commonly used for color-mixing applications. Then, the user or installer would set up the circuitry to power and control the LEDs. This may involve using resistors, transistors, and power supplies to ensure the LEDs receive the correct voltage and current. Then, the user or installer would choose a microcontroller (e.g., Arduino, Raspberry Pi, ESP8266, ESP32) that is suitable for the project based on factors such as required processing power, memory, and connectivity options. Then, the user or installer would connect the LEDs to the microcontroller according to the LED datasheet and microcontroller pinout. Make sure to connect the power supply and ground appropriately to power the LEDs and microcontroller. Then, the user or installer would utilize a suitable LED control library or framework (e.g., Adafruit NeoPixel, FastLED) compatible with the chosen microcontroller. These libraries simplify the process of controlling LEDs and creating various lighting effects. Then, the user or installer would write a program (code) for the microcontroller to control the LEDs. This program will define the desired lighting sequences, patterns, colors, and timing. Then, the user or installer would use the LED control library functions to set the color, intensity, and behavior of the LEDs. Then, the user or installer would define specific lighting sequences and animations using loops, conditional statements, and mathematical algorithms within the program. For example, you can create fading effects, color transitions, pulsating patterns, or complex animations. Then, the user or installer could incorporate mechanisms for user interaction, such as buttons, sensors, or communication interfaces (e.g., Bluetooth, Wi-Fi) to allow users to control or modify the lighting sequences in real-time. Then, the user or installer would compile the program and upload it to the microcontroller using the appropriate integrated development environment (IDE) and tools associated with the chosen microcontroller. Once the program is uploaded, the microcontroller will execute the defined instructions, resulting in the desired lighting display or animation-like sequences on the connected LEDs, which would then be transmitted upward through inserts 48 in paver 10.

When installed, pavers 10 should have durability and the ability to withstand heavy loads and harsh weather conditions. Pavers 10 may require minimal maintenance and can be easily cleaned with regular sweeping and occasional pressure washing. Pavers 10 may be utilized in patio construction, as they provide a level surface for outdoor seating, dining areas, or recreational spaces. Pavers 10 may also be used for creating walkways in residential or commercial landscapes, providing a durable and visually appealing path for pedestrians.

Paver 10 may additionally include one or more sensors to sense or gather data pertaining to the surrounding environment or operation of the paver 10 or the paved system that paver 10 is a component. Some exemplary sensors capable of being electronically coupled with the device, assembly, or system of the present disclosure (either directly connected to the paver 10, assembly, or system of the present disclosure or remotely connected thereto) may include but are not limited to: accelerometers sensing accelerations experienced during rotation, translation, velocity/speed, location traveled, elevation gained; gyroscopes sensing movements during angular orientation and/or rotation, and rotation; altimeters sensing barometric pressure, altitude change, terrain climbed, local pressure changes, submersion in liquid; impellers measuring the amount of fluid passing thereby; Global Positioning sensors sensing location, elevation, distance traveled, velocity/speed; audio sensors sensing local environmental sound levels, or voice detection; Photo/Light sensors sensing ambient light intensity, ambient, Day/night, UV exposure; TV/IR sensors sensing light wavelength; Temperature sensors sensing machine or motor temperature, ambient air temperature, and environmental temperature; and Moisture Sensors sensing surrounding moisture levels.

If sensors are utilized to gather data relating to the paver 10 or system of the present disclosure, then sensed data may be evaluated and processed with artificial intelligence (AI). Analyzing data gathered from sensors using artificial intelligence involves the process of extracting meaningful insights and patterns from raw sensor data to produce refined and actionable results. Raw data is gathered from various sensors, for example those which have been identified herein or others, capturing relevant information based on the intended analysis. This data is then preprocessed to clean, organize, and structure it for effective analysis. Features that represent key characteristics or attributes of the data are extracted. These features serve as inputs for AI algorithms, encapsulating relevant information essential for the analysis. A suitable AI model, such as machine learning or deep learning (regardless of whether it is supervised or unsupervised), is chosen based on the nature of the data and the desired analysis outcome. The model is then trained using labeled or unlabeled data to learn the underlying patterns and relationships. The model is fine-tuned and optimized to enhance its performance and accuracy. This process involves adjusting parameters, architectures, and algorithms to achieve better results. The trained model is used to make predictions or inferences on new, unseen data. The model processes the extracted features and generates refined output based on the patterns it has learned during training. The results produced by the AI model are refined through post-processing techniques to ensure accuracy and relevance. These refined results are then interpreted to extract meaningful insights and derive actionable conclusions. Feedback from the refined results is used to improve the AI model iteratively. The process involves incorporating new data, adjusting the model, and enhancing the analysis based on real-world feedback and evolving requirements.

For example, AI can play a role in utilizing data obtained from sensors on the pedestal paver 10 with a translucent waveguide insert 48 and an LED beneath it to change colors or light functions, whether for aesthetic or safety purposes. Sensors integrated into or coupled to the pedestal paver 10 can collect various types of data, such as ambient light levels, temperature, humidity, vibration, foot traffic, or even proximity of objects and people. These sensors may continuously or periodically monitor the surrounding environment. The data collected by the sensors can be fed into the AI system. AI algorithms process this data to understand the current environmental conditions and user behavior patterns. Machine learning models are used to train the AI system. This training involves providing the AI with historical data and teaching it to recognize patterns and correlations. For example, the AI can learn that certain environmental conditions or user behaviors are associated with specific lighting changes or color shifts. For aesthetic purposes, AI can adjust the LED lighting to create visually pleasing effects. The AI can analyze factors like time of day, weather conditions, nearby events, and user preferences to determine the appropriate lighting scheme. For example, it can create a serene blue ambiance on a quiet evening and a vibrant, dynamic light show during a lively festival. In terms of safety, the AI can take data from the sensors and make real-time decisions to improve pedestrian safety. For instance, it can detect when there is significant of foot traffic and adjust the lighting to enhance visibility. It could also sense environmental conditions like fog or rain and automatically increase the intensity of the LED lights to improve visibility and reduce the risk of accidents. It could also collectively illuminate desired lights to create visually identifiable patterns for safety purposes, such as creating arrows to identify foot traffic flow directions. AI can optimize energy usage by dimming the lights during low-traffic periods and increasing brightness when needed. It can adapt to natural light conditions, minimizing energy consumption while ensuring safety and aesthetics. The system can also allow user interaction through mobile apps or control panels. Users can select predefined lighting themes or request specific color changes for events, holidays, or personal preferences. The AI can incorporate these user inputs into its decision-making process. The AI system can continuously learn and adapt based on its observations and user feedback. It can refine its algorithms over time to provide better safety and aesthetic experiences. The AI system can log all the data it collects and the decisions it makes. This data can be analyzed to identify long-term trends, improve the system's performance, and enhance the overall user experience. By combining sensor data with AI capabilities, the pedestal paver 10 with the translucent waveguide 48 and LED can not only create stunning visual effects but also contribute to safety and energy efficiency, providing an adaptable and responsive lighting system for private residences, public spaces and/or urban environments.

Various inventive concepts may be embodied as one or more methods, of which an example has been provided. The acts performed as part of the method may be ordered in any suitable way. Accordingly, embodiments may be constructed in which acts are performed in an order different than illustrated, which may include performing some acts simultaneously, even though shown as sequential acts in illustrative embodiments.

While various inventive embodiments have been described and illustrated herein, those of ordinary skill in the art will readily envision a variety of other means and/or structures for performing the function and/or obtaining the results and/or one or more of the advantages described herein, and each of such variations and/or modifications is deemed to be within the scope of the inventive embodiments described herein. More generally, those skilled in the art will readily appreciate that all parameters, dimensions, materials, and configurations described herein are meant to be exemplary and that the actual parameters, dimensions, materials, and/or configurations will depend upon the specific application or applications for which the inventive teachings is/are used. Those skilled in the art will recognize, or be able to ascertain using no more than routine experimentation, many equivalents to the specific inventive embodiments described herein. It is, therefore, to be understood that the foregoing embodiments are presented by way of example only and that, within the scope of the appended claims and equivalents thereto, inventive embodiments may be practiced otherwise than as specifically described and claimed. Inventive embodiments of the present disclosure are directed to each individual feature, system, article, material, kit, and/or method described herein. In addition, any combination of two or more such features, systems, articles, materials, kits, and/or methods, if such features, systems, articles, materials, kits, and/or methods are not mutually inconsistent, is included within the inventive scope of the present disclosure.

Unless explicitly stated that a particular shape or configuration of a component is mandatory, any of the elements, components, or structures discussed herein may take the form of any shape. Thus, although the figures depict the various elements, components, or structures of the present disclosure according to one or more exemplary embodiments, it is to be understood that any other geometric configuration of that element, component, or structure is entirely possible. For example, instead of the inserts 48 or apertures 26 being T-shaped or I-shaped in cross-section and/or the inserts 48 or apertures 26 being circular when viewed from above or below, the inserts 48 or apertures can be semi-circular triangular, rectangular or square, pentagonal, hexagonal, heptagonal, octagonal, decagonal, dodecagonal, diamond shaped or another parallelogram, trapezoidal, star-shaped, oval, ovoid, lines or lined, teardrop-shaped, cross-shaped, donut-shaped, heart-shaped, arrow-shaped, crescent-shaped, any letter shape (i.e., A-shaped, B-shaped, C-shaped, D-shaped, E-shaped, F-shaped, G-shaped, H-shaped, I-shaped, J-shaped, K-shaped, L-shaped, M-shaped, N-shaped, O-shaped, P-shaped, Q-shaped, R-shaped, S-shaped, T-shaped, U-shaped, V-shaped, W-shaped, X-shaped, Y-shaped, or Z-shaped), or any other type of regular or irregular, symmetrical or asymmetrical configuration in either cross-section or in a plan view.

The above-described embodiments can be implemented in any of numerous ways. For example, embodiments of paver 10 that utilize the computer controlled light source disclosed herein may be implemented using hardware, software, or a combination thereof. When implemented in software, the software code or instructions can be executed on any suitable processor or collection of processors, whether provided in a single computer or distributed among multiple computers. Furthermore, the instructions or software code can be stored in at least one non-transitory computer readable storage medium.

Also, a computer or smartphone may be utilized to execute the software code or instructions for the computer controlled light source via its processors may have one or more input and output devices. These devices can be used, among other things, to present a user interface. Examples of output devices that can be used to provide a user interface include display screens for visual presentation of output. Examples of input devices that can be used for a user interface include keyboards, and pointing devices, such as mice, touch pads, and digitizing tablets. As another example, a computer may receive input information through speech recognition or in other audible format.

Such computers or smartphones that control the computer controlled light source may be interconnected by one or more networks in any suitable form, including a local area network or a wide area network, such as an enterprise network, and intelligent network (IN) or the Internet. Such networks may be based on any suitable technology and may operate according to any suitable protocol and may include wireless networks, wired networks or fiber optic networks.

The various methods or processes outlined herein for controlling the light source may be coded as software/instructions that is executable on one or more processors that employ any one of a variety of operating systems or platforms. Additionally, such software may be written using any of a number of suitable programming languages and/or programming or scripting tools, and also may be compiled as executable machine language code or intermediate code that is executed on a framework or virtual machine.

In this respect, various inventive concepts for controlling the light source in conjunction with paver 10 may be embodied as a computer readable storage medium (or multiple computer readable storage media) (e.g., a computer memory, one or more floppy discs, compact discs, optical discs, magnetic tapes, flash memories, USB flash drives, SD cards, circuit configurations in Field Programmable Gate Arrays or other semiconductor devices, or other non-transitory medium or tangible computer storage medium) encoded with one or more programs that, when executed on one or more computers or other processors, perform methods that implement the various embodiments of the disclosure discussed above. The computer readable medium or media can be transportable, such that the program or programs stored thereon can be loaded onto one or more different computers or other processors to implement various aspects of the present disclosure as discussed above.

The terms "program" or "software" or "instructions" are used herein in a generic sense to refer to any type of computer code or set of computer-executable instructions that can be employed to program a computer or other processor to implement various aspects of embodiments for controlling the light source as discussed above. Additionally, it should be appreciated that according to one aspect, one or more computer programs that when executed perform methods of the present disclosure need not reside on a single computer or processor, but may be distributed in a modular fashion amongst a number of different computers or processors to implement various aspects of the present disclosure.

Computer-executable instructions may be in many forms, such as program modules, executed by one or more computers or other devices. Generally, program modules include routines, programs, objects, components, data structures, etc. that perform particular tasks or implement particular abstract data types. Typically the functionality of the program modules may be combined or distributed as desired in various embodiments. As such, one aspect or embodiment of the present disclosure may be a computer program product including least one non-transitory computer readable storage medium in operative communication with a processor, the storage medium having instructions stored thereon that, when executed by the processor, implement a method or process for controlling the light source beneath paver 10 described herein, wherein the instructions comprise the steps to perform the method(s) or process(es) detailed herein.

Also, data structures may be stored in computer-readable media in any suitable form. For simplicity of illustration, data structures may be shown to have fields that are related through location in the data structure. Such relationships may likewise be achieved by assigning storage for the fields with locations in a computer-readable medium that convey relationship between the fields. However, any suitable mechanism may be used to establish a relationship between information in fields of a data structure, including through the use of pointers, tags or other mechanisms that establish relationship between data elements.

All definitions, as defined and used herein, should be understood to control over dictionary definitions, definitions in documents incorporated by reference, and/or ordinary meanings of the defined terms.

"Logic", as used herein, includes but is not limited to hardware, firmware, software, and/or combinations of each to perform a function(s) or an action(s), and/or to cause a function or action from another logic, method, and/or system. For example, based on a desired application or needs, logic may include a software controlled microprocessor, discrete logic like a processor (e.g., microprocessor), an application specific integrated circuit (ASIC), a programmed logic device, a memory device containing instructions, an electric device having a memory, or the like. Logic may include one or more gates, combinations of gates, or other circuit components. Logic may also be fully embodied as software. Where multiple logics are described, it may be possible to incorporate the multiple logics into one physical logic. Similarly, where a single logic is described, it may be possible to distribute that single logic between multiple physical logics.

The articles "a" and "an," as used herein in the specification and in the claims, unless clearly indicated to the contrary, should be understood to mean "at least one." The phrase "and/or," as used herein in the specification and in the claims (if at all), should be understood to mean "either or both" of the elements so conjoined, i.e., elements that are conjunctively present in some cases and disjunctively present in other cases. Multiple elements listed with "and/or" should be construed in the same fashion, i.e., "one or more" of the elements so conjoined. Other elements may optionally be present other than the elements specifically identified by the "and/or" clause, whether related or unrelated to those elements specifically identified. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc. As used herein in the specification and in the claims, "or" should be understood to have the same meaning as "and/or" as defined above. For example, when separating items in a list, "or" or "and/or" shall be interpreted as being inclusive, i.e., the inclusion of at least one, but also including more than one, of a number or list of elements, and, optionally, additional unlisted items. Only terms clearly indicated to the contrary, such as "only one of" or "exactly one of," or, when used in the claims, "consisting of," will refer to the inclusion of exactly one element of a number or list of elements. In general, the term "or" as used herein shall only be interpreted as indicating exclusive alternatives (i.e. "one or the other but not both") when preceded by terms of exclusivity, such as "either," "one of," "only one of," or "exactly one of." "Consisting essentially of," when used in the claims, shall have its ordinary meaning as used in the field of patent law.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein in the specification and in the claims, the term "effecting" or a phrase or claim element beginning with the term "effecting" should be understood to mean to cause something to happen or to bring something about. For example, effecting an event to occur may be caused by actions of a first party even though a second party actually performed the event or had the event occur to the second party. Stated otherwise, effecting refers to one party giving another party the tools, objects, or resources to cause an event to occur. Thus, in this example a claim element of "effecting an event to occur" would mean that a first party is giving a second party the tools or resources needed for the second party to perform the event, however the affirmative single action is the responsibility of the first party to provide the tools or resources to cause said event to occur.

When a feature or element is herein referred to as being "on" another feature or element, it can be directly on the other feature or element or intervening features and/or elements may also be present. In contrast, when a feature or element is referred to as being "directly on" another feature or element, there are no intervening features or elements present. It will also be understood that, when a feature or element is referred to as being "connected", "attached" or "coupled" to another feature or element, it can be directly connected, attached or coupled to the other feature or element or intervening features or elements may be present. In contrast, when a feature or element is referred to as being "directly connected", "directly attached" or "directly coupled" to another feature or element, there are no intervening features or elements present. Although described or shown with respect to one embodiment, the features and elements so described or shown can apply to other embodiments. It will also be appreciated by those of skill in the art that references to a structure or feature that is disposed "adjacent" another feature may have portions that overlap or underlie the adjacent feature.

Spatially relative terms, such as "under", "below", "lower", "over", "upper", "above", "behind", "in front of", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if a device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly. Similarly, the terms "upwardly", "downwardly", "vertical", "horizontal", "lateral", "transverse", "longitudinal", and the like are used herein for the purpose of explanation only unless specifically indicated otherwise.

Although the terms "first" and "second" may be used herein to describe various features/elements, these features/elements should not be limited by these terms, unless the context indicates otherwise. These terms may be used to distinguish one feature/element from another feature/element. Thus, a first feature/element discussed herein could be termed a second feature/element, and similarly, a second feature/element discussed herein could be termed a first feature/element without departing from the teachings of the present invention.

An embodiment is an implementation or example of the present disclosure. Reference in the specification to "an embodiment," "one embodiment," "some embodiments," "one particular embodiment," "an exemplary embodiment," or "other embodiments," or the like, means that a particular feature, structure, or characteristic described in connection with the embodiments is included in at least some embodiments, but not necessarily all embodiments, of the invention. The various appearances "an embodiment," "one embodiment," "some embodiments," "one particular embodiment," "an exemplary embodiment," or "other embodiments," or the like, are not necessarily all referring to the same embodiments.

If this specification states a component, feature, structure, or characteristic "may", "might", or "could" be included, that particular component, feature, structure, or characteristic is not required to be included. If the specification or claim refers to "a" or "an" element, that does not mean there is only one of the element. If the specification or claims refer to "an additional" element, that does not preclude there being more than one of the additional element.

As used herein in the specification and claims, including as used in the examples and unless otherwise expressly specified, all numbers may be read as if prefaced by the word "about" or "approximately," even if the term does not expressly appear. The phrase "about" or "approximately" may be used when describing magnitude and/or position to indicate that the value and/or position described is within a reasonable expected range of values and/or positions. For example, a numeric value may have a value that is +/−0.1% of the stated value (or range of values), +/−1% of the stated value (or range of values), +/−2% of the stated value (or range of values), +/−5% of the stated value (or range of values), +/−10% of the stated value (or range of values), etc. Any numerical range recited herein is intended to include all sub-ranges subsumed therein.

Additionally, the method of performing the present disclosure may occur in a sequence different than those described herein. Accordingly, no sequence of the method should be read as a limitation unless explicitly stated. It is recognizable that performing some of the steps of the method in a different order could achieve a similar result.

In the claims, as well as in the specification above, all transitional phrases such as "comprising," "including," "carrying," "having," "containing," "involving," "holding," "composed of," and the like are to be understood to be open-ended, i.e., to mean including but not limited to. Only the transitional phrases "consisting of" and "consisting essentially of" shall be closed or semi-closed transitional phrases, respectively.

To the extent that the present disclosure has utilized the term "invention" in various titles or sections of this specification, this term was included as required by the formatting requirements of word document submissions pursuant the guidelines/requirements of the United States Patent and Trademark Office and shall not, in any manner, be considered a disavowal of any subject matter.

In the foregoing description, certain terms have been used for brevity, clearness, and understanding. No unnecessary limitations are to be implied therefrom beyond the requirement of the prior art because such terms are used for descriptive purposes and are intended to be broadly construed.

Moreover, the description and illustration of various embodiments of the disclosure are examples and the disclosure is not limited to the exact details shown or described.

The invention claimed is:

1. A pedestal paver comprising:

a body having a first end and a second end defining a first direction therebetween, a first side and a second side defining a second direction therebetween, and a top surface and a bottom surface defining a third direction therebetween;

a plurality of apertures extending fully through the body from the top surface to the bottom surface, wherein at least one aperture is countersunk from the top surface thereby defining a surface that delineates an upper portion of the at least one aperture and a lower portion of the at least one aperture, wherein the upper portion of the at least one aperture has a dimension greater than that of the lower portion of the at least one aperture, wherein the dimension is measured parallel to one of the first direction and the second direction;

a first row of apertures from the plurality of apertures, wherein the first row is aligned in the first direction;

a second row of apertures from the plurality of apertures, wherein the second row is aligned in the first direction;

wherein a central axis of the at least one aperture that is in the first row is offset, relative to the second direction, from a second central axis of a second aperture in the second row;

a waveguide insert that is formed from a translucent or transparent material disposed within the at least one aperture, wherein the waveguide insert is adapted to permit the transmission of light in the third direction through the waveguide insert; and a corner of the body that is to be supported from the bottom surface by a pedestal that elevates the pedestal paver above a base layer or support structure.

2. The pedestal paver of claim 1, wherein the countersunk configuration of the at least one aperture is a flat countersink.

3. The pedestal paver of claim 1, wherein the countersunk configuration of the at least one aperture is a tapered countersink.

4. The pedestal paver of claim 1, wherein the countersunk configuration of the at least one aperture is a conical countersink.

5. The pedestal paver of claim 1, wherein the countersunk configuration of the at least one aperture is a beveled countersink.

6. The pedestal paver of claim 1, wherein the countersunk configuration of the at least one aperture is a curved countersink.

7. The pedestal paver of claim 1, wherein the countersunk configuration of the at least one aperture is a rounded countersink.

8. The pedestal paver of claim 1, wherein the waveguide insert is T-shaped in cross section and complementary to a cross-sectional configuration of a portion of the body that defines the at least one aperture.

9. The pedestal paver of claim 1, wherein the surface is a flat annular surface defining a ledge that circumscribes a central axis of the at least one aperture.

10. The pedestal paver of claim 1, wherein an amount of apertures in the first row is greater than an amount of apertures in the second row.

11. The pedestal paver of claim 10, wherein the amount of apertures in the first row is greater than the amount of apertures in the second row by one.

12. The pedestal paver of claim 1, wherein an amount of apertures in the first row is equal to an amount of apertures in the second row.

13. The pedestal paver of claim 1, wherein the at least one aperture in the first row is offset, relative to the second direction, from the second central axis of the second aperture in the second row by a distance that is at least equal to a radius of the at least one aperture in the first row and at most equal to twice the diameter of the at least one aperture in the first row.

14. The pedestal paver of claim 1, further comprising a radial surface of the waveguide insert, wherein the radial surface is reflective to direct light upwardly through the waveguide insert in the third direction.

15. The pedestal paver of claim 1, wherein the plurality of apertures are arranged in a grid pattern or a circular pattern.

16. A pedestal paver system comprising:

a body having a first end and a second end defining a first direction therebetween, a first side and a second side defining a second direction therebetween, and a top surface and a bottom surface defining a third direction therebetween;

four corners of the body, wherein the four corners are supported at the bottom surface by four pedestals, respectively, wherein the four pedestals elevate the pedestal paver above a base layer or support structure to define a space between the bottom surface of the body and the base layer or support structure, wherein the space below the body is sized to accommodate a light source that transmits light;

a central portion of the body that is equidistant from the four corners, wherein the central portion of the body is suspended above the base layer or support structure, and the central portion is not in physical contact with any pedestal or other structure that otherwise supports the body;

a plurality of apertures extending fully through the body from the top surface to the bottom surface; and a waveguide insert that shaped complementary to at least one aperture from the plurality of aperture and disposed within the at least one aperture, and the waveguide insert is formed from a translucent or transparent material, wherein the waveguide insert is adapted to permit light transmission from the light source in the third direction through the waveguide insert.

17. A pedestal paver method of installation comprising:

aligning a corner of a body of pedestal paver with a pedestal, the body of the pedestal paver having a first end and a second end defining a first direction therebetween, a first side and a second side defining a second direction therebetween, and a top surface and a bottom surface defining a third direction therebetween;

connecting the corner at the bottom surface of the body of the pedestal paver with the pedestal, wherein the pedestal is supported from below by a base layer or support structure;

elevating the pedestal paver above the base layer or support structure thereby creating a space between the bottom surface of the pedestal paver and the base layer or support structure;

suspending a central portion of the body of the pedestal paver above the base layer or support structure, wherein the central portion is centrally offset from the corner, and the central portion is not in physical contact with any pedestal or other structure that otherwise supports the pedestal paver;

disposing a light source in the space below the bottom surface of the pedestal paver; and activating the light source, wherein light from the light source propagates upwardly in the third direction through a waveguide insert that is formed from a translucent or transparent material disposed within an aperture defined within and extending fully through the body of the pedestal paver.

18. The method of installation of claim 17, wherein the aperture within which the waveguide insert is disposed is countersunk from the top surface thereby defining a surface that delineates an upper portion of the aperture and a lower portion the aperture, wherein the upper portion of the at least one aperture has a greater diameter than the lower portion of the at least one aperture.

* * * * *